US012434293B2

(12) United States Patent
Araki et al.

(10) Patent No.: US 12,434,293 B2
(45) Date of Patent: Oct. 7, 2025

(54) PUNCH FOR RIVETING, DEVICE IN WHICH PUNCH FOR RIVETING IS DISPOSED, AND METHOD FOR JOINING MEMBERS

(71) Applicant: NHK SPRING CO., LTD., Yokohama (JP)

(72) Inventors: Yoshihito Araki, Yokohama (JP); Yuusuke Fukuoka, Yokohama (JP); Nobuyuki Furugori, Yokohama (JP)

(73) Assignee: NHK SPRING CO., LTD., Yokohama (JP)

( * ) Notice: Subject to any disclaimer, the term of this patent is extended or adjusted under 35 U.S.C. 154(b) by 0 days.

(21) Appl. No.: 18/885,162

(22) Filed: Sep. 13, 2024

(65) Prior Publication Data

US 2025/0001481 A1 Jan. 2, 2025

Related U.S. Application Data

(63) Continuation of application No. PCT/JP2023/003203, filed on Feb. 1, 2023.

(30) Foreign Application Priority Data

Mar. 16, 2022 (JP) ..... 2022-041080

(51) Int. Cl.
*B21J 15/02* (2006.01)
*B21J 15/12* (2006.01)
*B21J 15/26* (2006.01)

(52) U.S. Cl.
CPC ..... *B21J 15/02* (2013.01); *B21J 15/12* (2013.01); *B21J 15/26* (2013.01); *Y10T 29/49956* (2015.01)

(58) Field of Classification Search
CPC .. B21J 15/02; B21J 15/12; B21J 15/26; Y10T 29/49956
See application file for complete search history.

(56) References Cited

U.S. PATENT DOCUMENTS 1,672,567 A * 6/1928 Hawley ..... B21J 15/046 29/522.1
2,739,726 A * 3/1956 Bregen ..... A43D 100/02 72/126

(Continued)

FOREIGN PATENT DOCUMENTS

CN 104889270 A * 9/2015 ..... B21D 39/021
CN 112091063 A * 12/2020 ..... B21D 28/34

(Continued)

OTHER PUBLICATIONS

Written Opinion (PCT/ISA/237) dated Apr. 18, 2023 issued in PCT/JP2023/003203, 8 pages.

(Continued)

*Primary Examiner* — Jermie E Cozart
(74) *Attorney, Agent, or Firm* — Quarles & Brady LLP

(57) ABSTRACT

A novel punch for riveting with reduced load on a shaft of a rivet is provided. Alternatively, a device that is disposed with a novel punch for riveting with reduced load on a shaft of a rivet is provided. Alternatively, a method for joining members using a novel punch for riveting with reduced load on a shaft of a rivet is provided. A punch for riveting according to an embodiment of present invention includes joining a first member having a convex part and a second member having a through hole fitting with the convex part by plastically deforming the convex part, wherein a contact surface with the convex part is inclined in a range of 80° to 89° with respect to a center axis.

13 Claims, 10 Drawing Sheets

(56) References Cited

U.S. PATENT DOCUMENTS

| | | | | | |
|---|---|---|---|---|---|
| 3,173,281 | A * | 3/1965 | Gottfried | B21J 15/12 | 227/51 |
| 3,768,289 | A | 10/1973 | Mink | | |
| 3,800,579 | A * | 4/1974 | Breiter | B23Q 1/5462 | 72/67 |
| 3,990,285 | A * | 11/1976 | Dragoun | B21J 15/12 | 72/429 |
| 4,041,596 | A * | 8/1977 | Mink | B21J 15/12 | 72/125 |
| 4,069,698 | A * | 1/1978 | Dragoun | B21J 9/025 | 72/406 |
| 4,984,443 | A * | 1/1991 | Sato | B21J 9/025 | 72/406 |
| 6,741,395 | B1 * | 5/2004 | Johnson | G02B 30/27 | 359/619 |
| 2018/0257124 | A1 * | 9/2018 | Jung | B21D 41/02 | |

FOREIGN PATENT DOCUMENTS

| | | | | | |
|---|---|---|---|---|---|
| DE | 102016217581 | A1 | 3/2018 | | |
| EP | 0699490 | A1 * | 3/1996 | B21J 15/12 | |
| GB | 191113543 | A * | 3/1912 | B21J 15/12 | |
| JP | S51142684 | U | 11/1976 | | |
| JP | S5466286 | U | 5/1979 | | |
| JP | S5566032 | U | 5/1980 | | |
| JP | S5912102 | Y2 * | 4/1984 | B21J 9/025 | |
| JP | S62105736 | U | 7/1987 | | |
| JP | H01241346 | A | 9/1989 | | |
| JP | H0318444 | A | 1/1991 | | |
| JP | H05293584 | A | 11/1993 | | |
| JP | H08117896 | A | 5/1996 | | |
| JP | 2756145 | B2 | 5/1998 | | |
| JP | 3313754 | B2 * | 8/2002 | B21J 15/12 | |
| JP | 2003112227 | A | 4/2003 | | |

OTHER PUBLICATIONS

ISR (PCT/ISA/210) dated Apr. 18, 2023 issued in PCT/JP2023/003203, 5 pages.

WO-ISA (PCT/ISA/237) dated Apr. 18, 2023 issued in PCT/JP2023/003203, 4 pages.

Office Action dated Sep. 20, 2023 issued in TW Appl. No. 112108404, 10 pages.

Extended European Search Report (EESR) of European Application No. 23770140.4, mailed Jun. 25, 2025 (8 pages).

* cited by examiner

PUNCH FOR RIVETING, DEVICE IN WHICH PUNCH FOR RIVETING IS DISPOSED, AND METHOD FOR JOINING MEMBERS

CROSS-REFERENCE TO RELATED APPLICATIONS

This application is a Continuation of International Patent Application No. PCT/JP2023/003203, filed on Feb. 1, 2023, which claims the benefit of priority to Japanese Patent Application No. 2022-041080, filed on Mar. 16, 2022, the entire contents of which are incorporated herein by reference.

FIELD

The present invention relates to a punch for riveting. Alternatively, the present invention relates to a device in which the punch for riveting is disposed. Alternatively, the present invention relates to a method for joining members using the punch for riveting.

BACKGROUND

For example, welding is known as a method for joining two or more members made of metal. In the case where two or more members are joined by welding, there are problems such as that a strain is generated in the member due to thermal effects, or that cracks extend from fine cracks in a welded portion due to the effects of temperature when the joined product is used.

On the other hand, riveting using rivets is known as a joining method that does not have a heat effect on the member. Blind rivets, press riveting (for example, Japanese Laid-Open Patent Publication No. H1-241346) and spin riveting as known methods of riveting (for example, Japanese Patent No. 2756145, and Japanese Laid-Open Patent Publication No. 2003-112227). A fastening pressure is determined by the breaking strength of a mandrel in the blind rivet that deforms and fixes the inside of a cylindrical rivet by pulling the mandrel. Therefore, the blind rivet has a problem of lower strength than other riveting methods. Further, the press riveting has a problem in that a shaft of a riveted rivet is deformed due to high press pressure. On the other hand, in the spin riveting method, a load pressure is not higher than in the press riveting method, and the effects on the member are also small.

SUMMARY

An object of an embodiment of the present invention is to provide a novel punch for riveting with reduced load on a shaft of a rivet. Alternatively, another object of the present invention is to provide a device in which a novel punch for riveting with reduced load on a shaft of a rivet is disposed. Alternatively, another object of an embodiment of the present invention is to provide a method for joining members using a novel punch for riveting with reduced load on a shaft of a rivet.

A punch for riveting according to an embodiment of the present invention is a punch for riveting for joining a first member having a convex part and a second member having a through hole fitting with the convex part by plastically deforming the convex part, wherein a contact surface with the convex part is inclined in a range of 80° to 89° with respect to a center axis.

The punch for riveting may rotate around the center axis.

The punch for riveting may contain a cemented carbide alloy.

The contact surface may have an arithmetic average roughness Ra of 3.2 or less.

The punch for riveting may further include a coating composed of diamond-like carbon arranged on the contact surface.

A device according to an embodiment of the present invention includes a main shaft holding the punch for riveting according to any one of the above, and a table arranged opposite to the main shaft, the table capable of holding a first member and a second member, wherein the punch for riveting and the first member are arranged so that the center axis of the punch for riveting corresponds to a center axis of the first member, and the main shaft rotates the punch for riveting around the center axis of the punch for riveting.

A joining method of members according to an embodiment of the present invention includes fitting a convex part of a first member and a through hole of a second member, and rotating and pressing a punch having a contact surface with the convex part inclined in a range of 80° to 89° with respect to a center axis.

The punch may rotate around the center axis.

The first member and the second member may be joined by plastically deforming the convex part.

The punch may contain a cemented carbide alloy.

The contact surface of the punch may be polished.

The contact surface of the punch may be coated with diamond-like carbon.

A center of the convex part may be arranged on the center axis.

An inner surface of the through hole may include an area parallel to or inclined with respect to the center axis.

DESCRIPTION OF EMBODIMENTS

Figure 1:
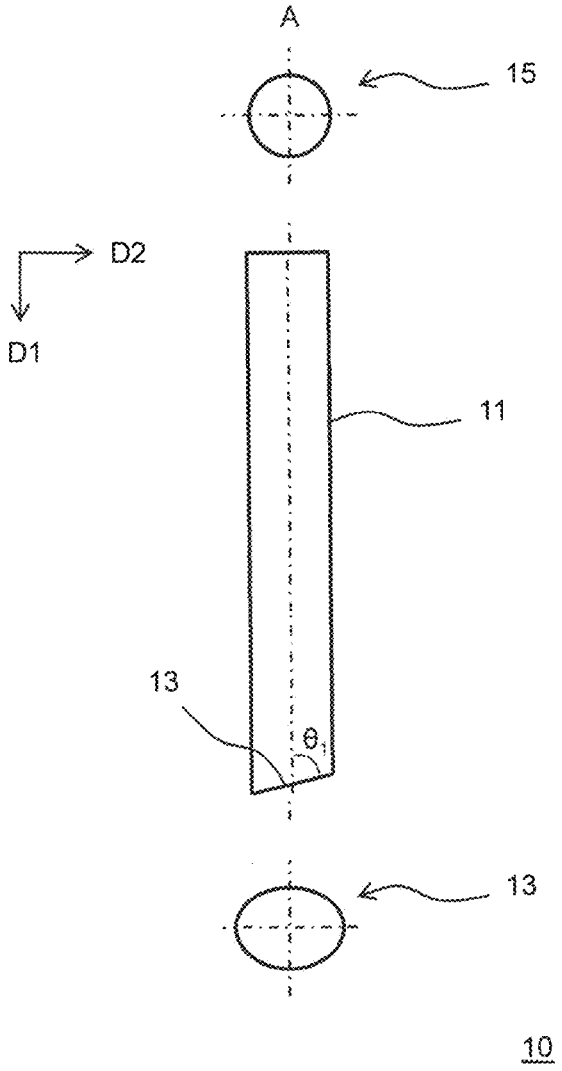
FIG. 1 is a schematic view showing a punch for riveting 10 according to an embodiment of the present invention.

Hereinafter, an embodiment of the present invention will be described with reference to the drawings. The following embodiments are examples of embodiments of the present invention, and the present invention is not limited to these embodiments.

In the drawings referred to in the present embodiment, the same or similar parts are denoted by the same reference signs or similar reference signs (only denoted by A, B, etc. after numerals). In addition, the dimensional ratios in the drawings may be different from actual ratios for convenience of explanation, or a part of the configuration may be omitted from the drawings. In addition, ordinal numbers such as "first," "second," and "third" in the present specification and the like are used only for the sake of simplicity, and should not be interpreted in a limiting manner.

Figure 5:
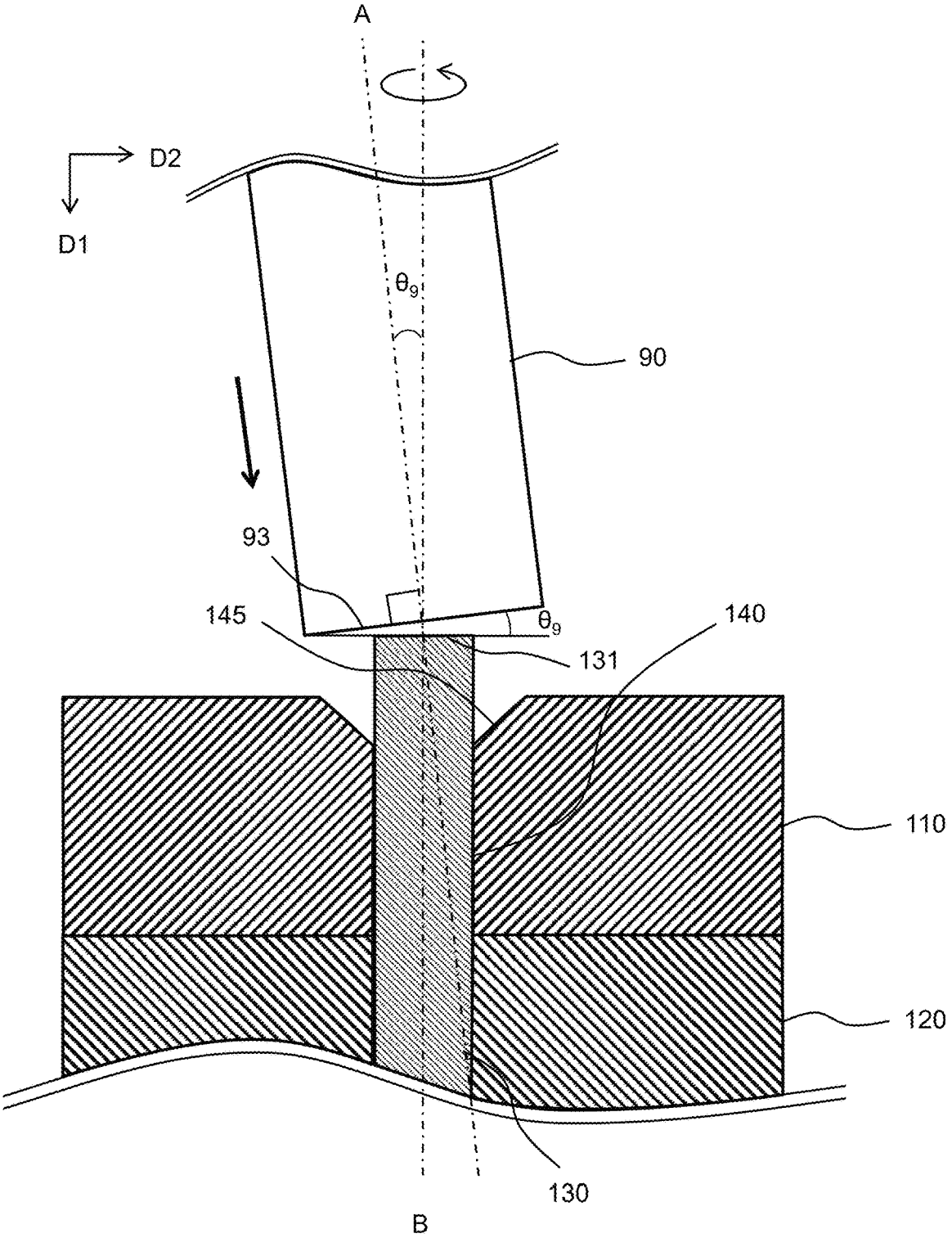
FIG. 5 Prior Art
FIG. 5 is a schematic view showing a method for joining members by a conventional spin riveting method.

As a result of intensive studies by the present inventors, it has been found that in a conventional spin riveting method, when plastically deforming a convex part (end portion) of a rivet and enlarging the end portion of the rivet more than a diameter of a through hole, a gap occurs between the enlarged end portion and the through hole. FIG. 5 is a schematic view showing a conventional method for joining members by spin riveting. A through hole 140 for arranging a rivet 130 is disposed in a first member 110 and a second member 120. A convex part (end portion) 131 of the rivet 130 protruding from the through hole 140 on the first member 110 side is riveted by a conventional punch for spin riveting 90. The conventional punch 90 for spin riveting has a contact surface 93 that is orthogonal) (90° to a center axis A of the conventional punch 90 for spin riveting. Further, the center axis A of the conventional punch 90 for spin riveting is attached to a spin riveting device (not shown) so as to be inclined by $\theta_9$ with respect to a center axis B of the rivet 130. $\theta_9$ is, for example, 3 to 5°.

The conventional punch 90 for spin riveting is pressed against the convex part 131 of the rivet 130 by driving the spin riveting device while rotating the center axis A as a rotation axis. In this case, a direction in which the conventional punch 90 for spin riveting presses against the convex part 131 of the rivet 130 is a direction inclined $\theta_9$ with respect to the center axis B of the rivet 130 as indicated by the arrow in FIG. 5. Further, in the conventional spin riveting device, the entire punch 90 for spin riveting is rotated with the center axis B of the rivet 130 as a rotational axis while the punch 90 for spin riveting is inclined by $\theta_9$ with respect to the center axis B of the rivet 130. Therefore, in an initial stage of a riveting process, the punch 90 for spin riveting contacts a corner portion of the convex part 131 of the rivet 130 with the center axis B of the rivet 130 as the rotation axis.

Figure 6:
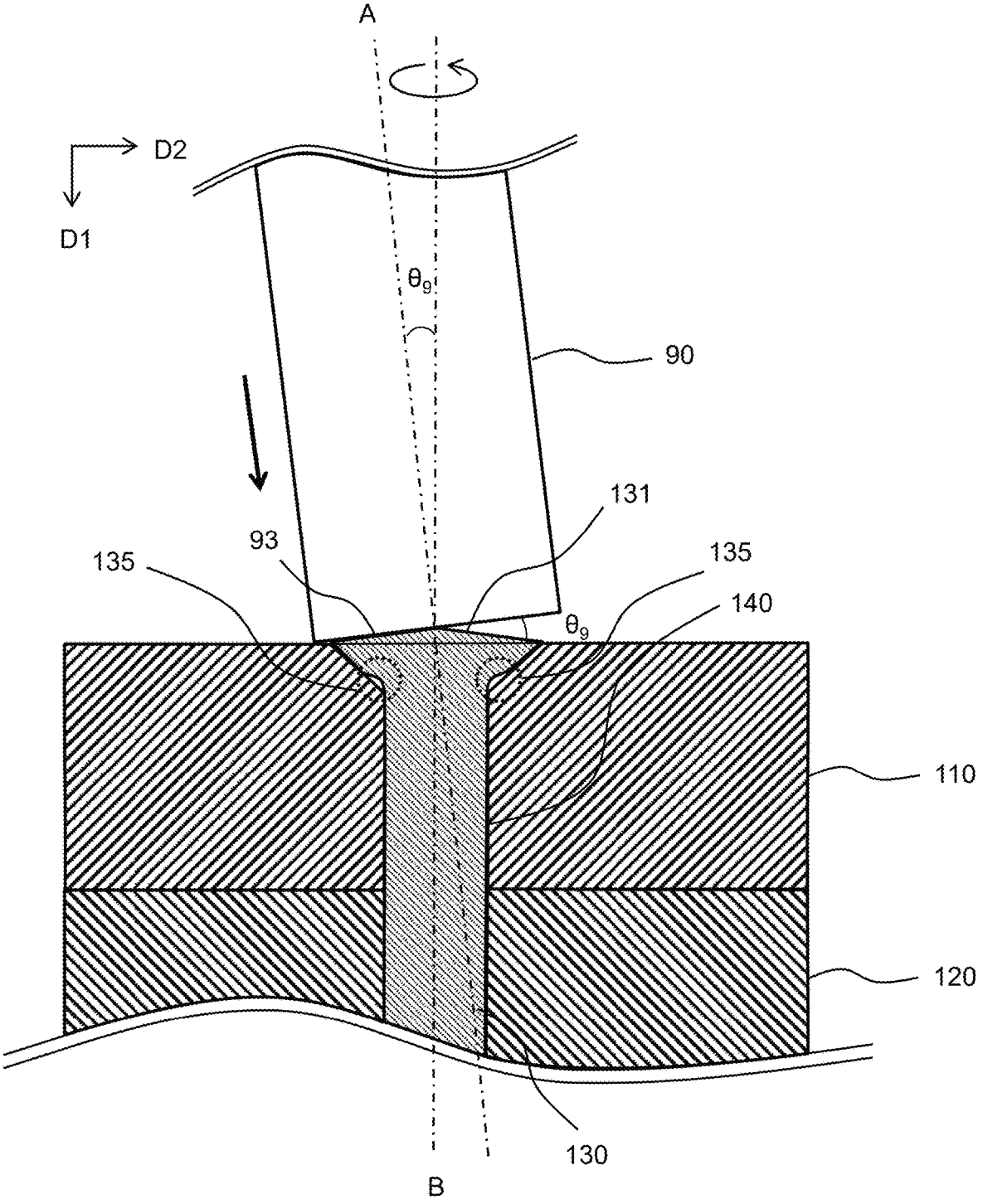
FIG. 6 Prior Art
FIG. 6 is a schematic view showing the method for joining the members by the conventional spin riveting method.

FIG. 6 is a schematic view showing a conventional method for joining members by the spin riveting method. FIG. 6 shows an end stage of the riveting process. In the conventional spin riveting device, the entire punch 90 for spin riveting is rotated with respect to the center axis B of the rivet 130 as a rotation axis while the punch 90 for spin riveting is rotated with respect to the center axis A as a rotation axis. Further, the punch 90 for spin riveting is moved in a center axis B direction of the rivet 130 until it comes into contact with the first member 110. A material constituting the convex part 131 of the rivet 130 is plastically deformed by this riveting process, and moves in the center axis B direction of the rivet 130 (vertical direction D1) and a plane direction of the first member 110 (horizontal direction D2). As a result, the convex part 131 of the rivet 130 becomes larger than a diameter of the through hole 140, and the first member 110 and the second member 120 are joined by the rivet 130.

However, a direction in which the conventional punch 90 for spin riveting presses is a direction inclined $\theta_9$ with respect to the center axis B of the rivet 130 as shown in FIG. 6, so that the plastically deformed material constituting the convex part 131 of the rivet 130 generates a gap 135 in the enlarged diameter portion 145 of the through hole 140 disposed in the first member 110. Such a gap 135 can become larger due to temperature effects when the product is used, and can cause fine cracks in the rivet 130.

Punch for Riveting

FIG. 1 is a schematic view showing a punch 10 for riveting according to an embodiment of the present invention. The punch 10 for riveting can be used by being connected to a known machining center (not shown). The punch 10 for riveting has a substantially cylindrical shape. An upper surface 15 of the punch 10 for riveting connected to the machining center or the like may be circular. A side surface 11 of the punch 10 for riveting in a cross-sectional view has a trapezoidal shape having an upper bottom and a lower bottom in a vertical direction D1. Further, a contact surface 13 of the punch 10 for riveting for pressing the rivet is inclined by $\theta_1$ with respect to the center axis A of the punch 10 for riveting. In an embodiment, $\theta_1$ is preferably in a range of 80° to 89°. For this reason, the contact surface 13 has an elliptical shape in which a direction inclined by $\theta_1$ is set to a major axis.

In an embodiment, the punch 10 for riveting preferably includes a cemented carbide alloy or a Ni base alloy, and more preferably is made of a cemented carbide alloy from the viewpoint of abrasion resistance to rivets. In the present specification, the cemented carbide alloy is a composite material obtained by sintering a carbide of IVa, Va, VIa metal of the periodic table with an iron-based metal such as Fe, Co, and Ni, and may be selected from, but not limited to, a WC-Co alloy, a WC-TiC-Co alloy, a WC-TaC-Co alloy, a WC-TiC-TaC-Co alloy, and the like. In addition, a Ni base alloy may be selected from, but not limited to, Inconel, Incoloy, Nimonic, Hastelloy, and the like.

In an embodiment, the contact surface 13 may be polished for the purpose of reducing friction when the rivet is riveted. For example, it is preferable that the contact surface 13 is subjected to mirror finishing polishing by a diamond grindstone or the like. In an embodiment, the arithmetic average roughness Ra of the contact surface 13 is preferably 3.2 or less, more preferably 0.3 or less, and even more preferably 0.1 or less. Such a contact surface 13 has a reduced contact resistance with the rivet and can suppress generation of frictional heat. Since the punch 10 for riveting has such a contact surface 13, it is possible to prevent aluminum from being welded to the contact surface 13 when the rivet made of aluminum or the like is riveted.

In addition, in an embodiment, from the viewpoint of abrasion resistance when the rivet is riveted, the contact surface 13 preferably includes a coating made of diamond-like carbon (DLC). In addition, since a known coating technique can be applied to the technique of forming a DLC film on the contact surface 13, detailed explanation thereof will be omitted. The contact surface 13 including the DLC coating is also preferred for the purpose of reducing friction when riveting the rivet. The contact surface 13 including the DLC coating has a reduced contact resistance with the rivet and can suppress generation of frictional heat. Since the punch 10 for riveting has such a contact surface 13, it is possible to prevent aluminum from being welded to the contact surface 13 when the rivet made of aluminum or the like is riveted.

The punch 10 for riveting has a diameter perpendicular to the center axis A, but may have a diameter that is 1 to 2 mm larger than the maximum diameter of an enlarged diameter portion of a through hole of a member in which the rivet to be described later is disposed. When using a punch for riveting having a diameter smaller than the maximum diameter of the enlarged diameter portion of the through hole, a ring-shaped gap in which the material of the rivet is not filled in the edge portion of the enlarged diameter portion is generated, which is not preferable. The punch 10 for riveting has a length parallel to the center axis A, but is not particularly limited as long as the length is in a range in which necessary strength can be obtained and a range in which it can be handled. In addition, in the specification, the length of the punch 10 for riveting is defined as a distance from the upper surface 15 to a point on the contact surface 13 that is furthest away.

Device in Which Punch for Riveting is Disposed

Figure 2A:
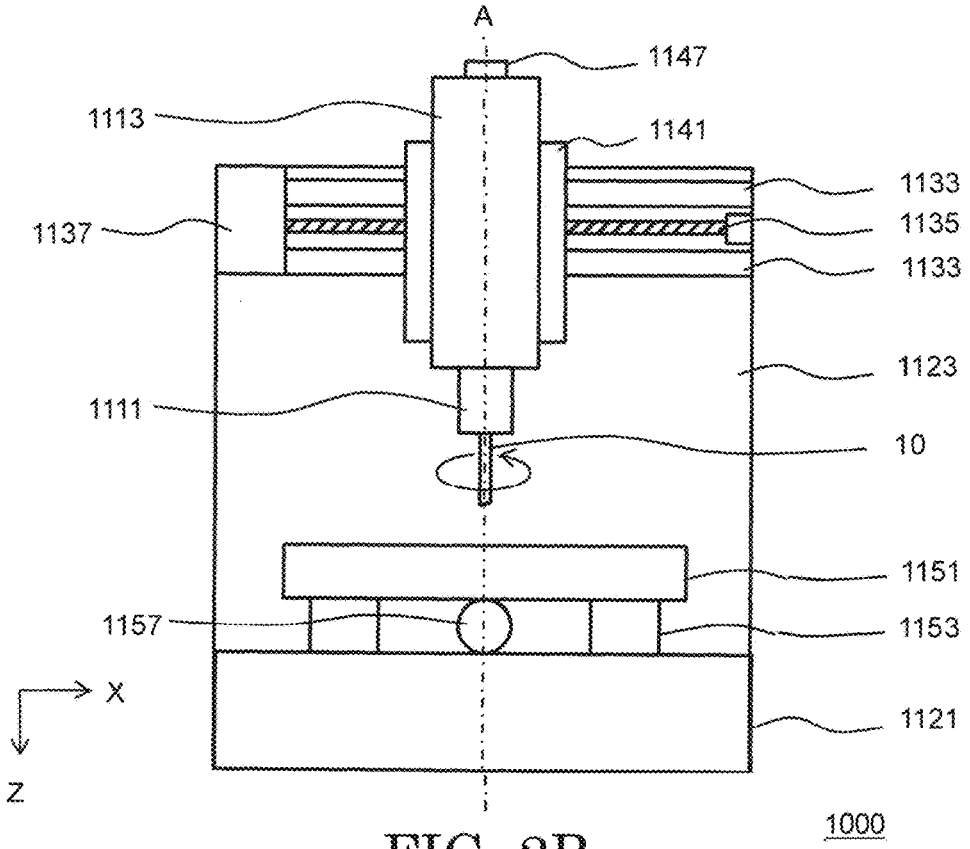
FIG. 2A is a front view of a device 1000 according to an embodiment.
Figure 2B:
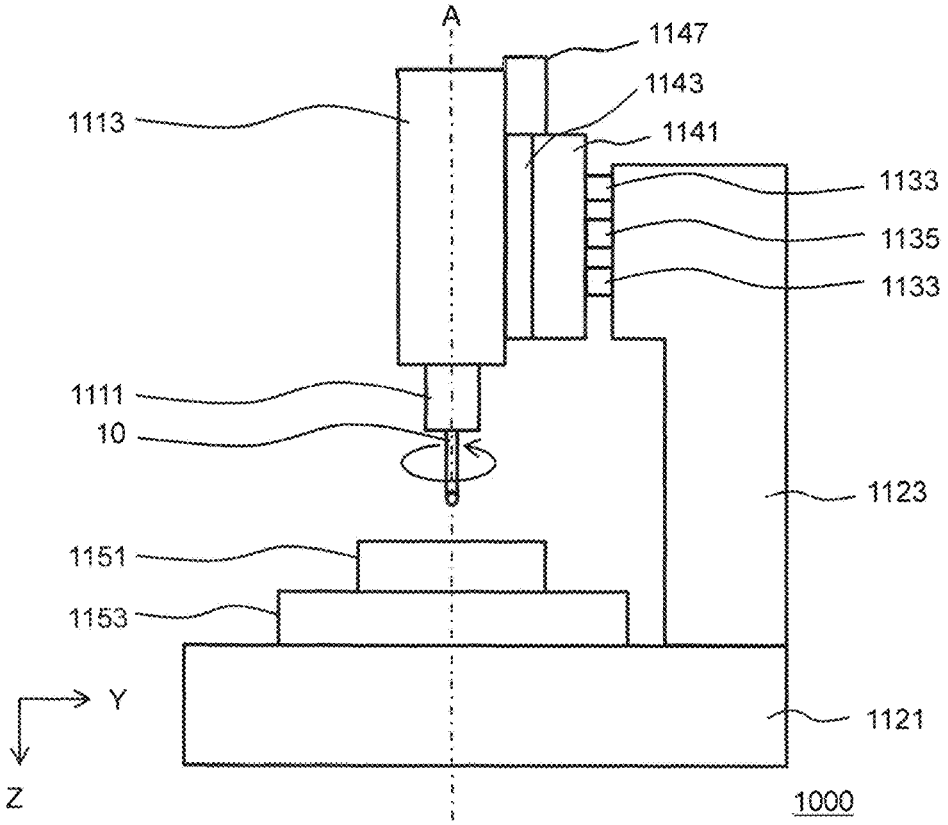
FIG. 2B is a side view of a device 1000 according to an embodiment.

A device for performing riveting using the punch 10 for riveting described above will be described. FIG. 2A and 2B are schematic diagrams showing a device 1000 according to an embodiment of the present invention, FIG. 2A is a front view of the device 1000, and FIG. 2B is a side view of the device 1000. The device 1000 includes a main shaft 1111 that holds the punch 10 for riveting, and a table 1151 that is disposed to face the main shaft 1111 and is capable of holding the rivet 130, the first member 110, and the second member 120. The punch 10 for riveting and the rivet 130 are arranged so that the center axis A of the punch 10 for riveting coincides with the center axis B of the rivet 130. The main shaft 1111 has a chuck for detachably holding the punch 10 for riveting, and rotates the punch 10 for riveting around the center axis A of the punch 10 for riveting.

In an embodiment, the device 1000 includes, for example, a main shaft head 1113 that rotatably supports the main shaft 1111, a column 1123 that supports the main shaft head 1113, and a bed 1121 that supports the column 1123. The main shaft head 1113 is movably supported by a main shaft stage 1141. Further, the main shaft stage 1141 is movably supported by the column 1123. Here, in FIG. 4, a left-right direction of a paper surface is defined as an X-axis direction, and an up-down direction of the paper surface perpendicular to the X-axis direction is defined as a Z-axis direction.

Two rails 1143 are arranged parallel to the Z-axis direction between the main shaft head 1113 and the main shaft stage 1141. The main shaft head 1113 movably engages with the two rails 1143 to slide in the Z-axis direction. For example, a ball screw (not shown) is arranged between the two rails 1143, and the ball screw is connected to the main shaft head 1113. Further, one end of the ball screw is connected to a Z-axis driving device 1147 to move the main shaft head 1113 in the Z-axis direction. The Z-axis driving device 1147 is a motor for rotating the ball screw. The main shaft head 1113 is displaceable in the Z-axis direction by such a mechanism while rotating the main shaft 1111. That is, the main shaft head 1113 can be moved in the Z-axis direction while rotating the main shaft 1111 in a state in which the main shaft 1111 holds the punch 10 for riveting.

Two rails 1133 are arranged parallel to the X-axis direction between the main shaft stage 1141 and the column 1123. The main shaft stage 1141 movably engages with the two rails 1133 to slide in the X-axis direction. For example, a ball screw 1135 is arranged between the two rails 1133, and the ball screw 1135 is connected to the main shaft stage 1141. Further, one end of the ball screw 1135 is connected to an X-axis driving device 1137, and moves the main shaft stage 1141 in the X-axis direction. The X-axis driving device 1137 is a motor for rotating the ball screw 1135.

In FIG. 2B, a left-right direction of a paper surface is defined as the Y-axis direction, and an up-down direction of the paper surface perpendicular to the Y-axis direction is defined as the Z-axis direction. Two rails 1153 are arranged parallel to the Y-axis direction between the table 1151 and the bed 1121. The table 1151 movably engages with the two rails 1153 to slide in the Y-axis direction. For example, a ball screw (not shown) is arranged between the two rails 1153, and the ball screw is connected to the table 1151. Further, one end of the ball screw is connected to a Y-axis driving device 1157, and moves the table 1151 in the Y-axis direction. The Y-axis driving device 1157 is a motor for rotating the ball screw.

Although not shown, a control device capable of controlling the device 1000 is connected to the device 1000. The control device includes, for example, a computer and a program for controlling the device 1000. The control device controls a rotational speed of the main shaft head 1113, a position of the main shaft head 1113 in the X-axis direction and the Z-axis direction, and a position of the table 1151 in the Y-axis direction. The device 1000 having such a configuration can arbitrarily change a positional relationship between the punch 10 for riveting, the rivet 130 and the first member 110 and the second member 120 arranged and fixed to the table 1151 in the X-axis direction, the Y-axis direction, and the Z-axis direction.

Figure 4:
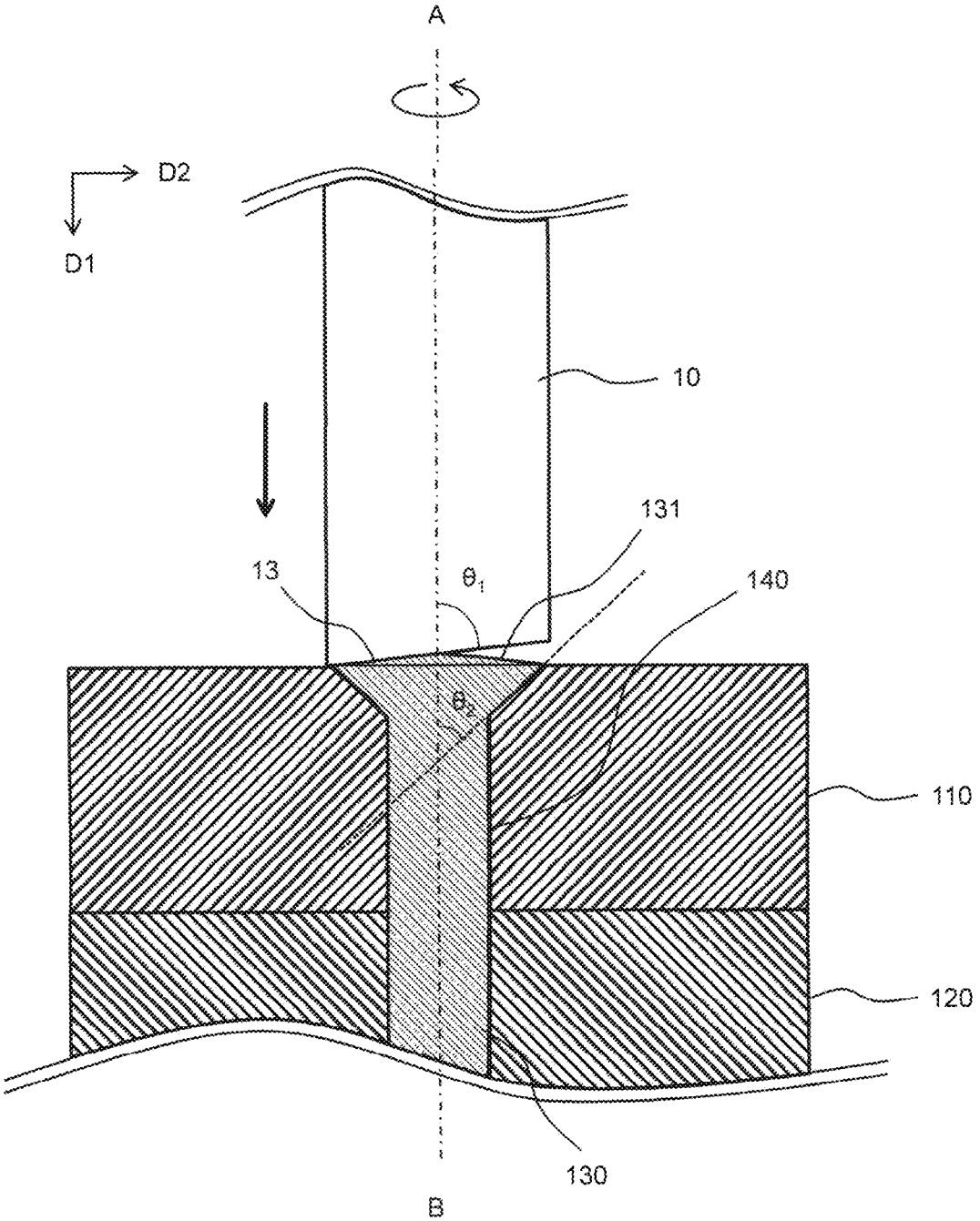
FIG. 4 is a schematic view showing a method for joining members using the punch 10 for riveting according to an embodiment of the present invention.

The punch 10 for riveting according to the present embodiment described above is arranged in the device 1000, and as shown in FIG. 4, the punch 10 for riveting and the rivet 130 are arranged so that the center axis A of the punch 10 for riveting and the center axis B of the rivet 130 coincide with each other. In an embodiment, the device 1000 can be configured by disposing the punch 10 for riveting according to the present embodiment in a known machining center. In addition, although the present embodiment has been described as an example in which a three-axis machining center is used, the device 1000 according to the present embodiment is not limited to this. As long as it has a structure in which the punch 10 for riveting and the rivet 130 can be arranged such that the center axis A of the punch 10 for riveting and the center axis B of the rivet 130 coincide with each other, a 4-axis or 5-axis machining center can be used for the device 1000.

Method for Joining Members

Figure 3:
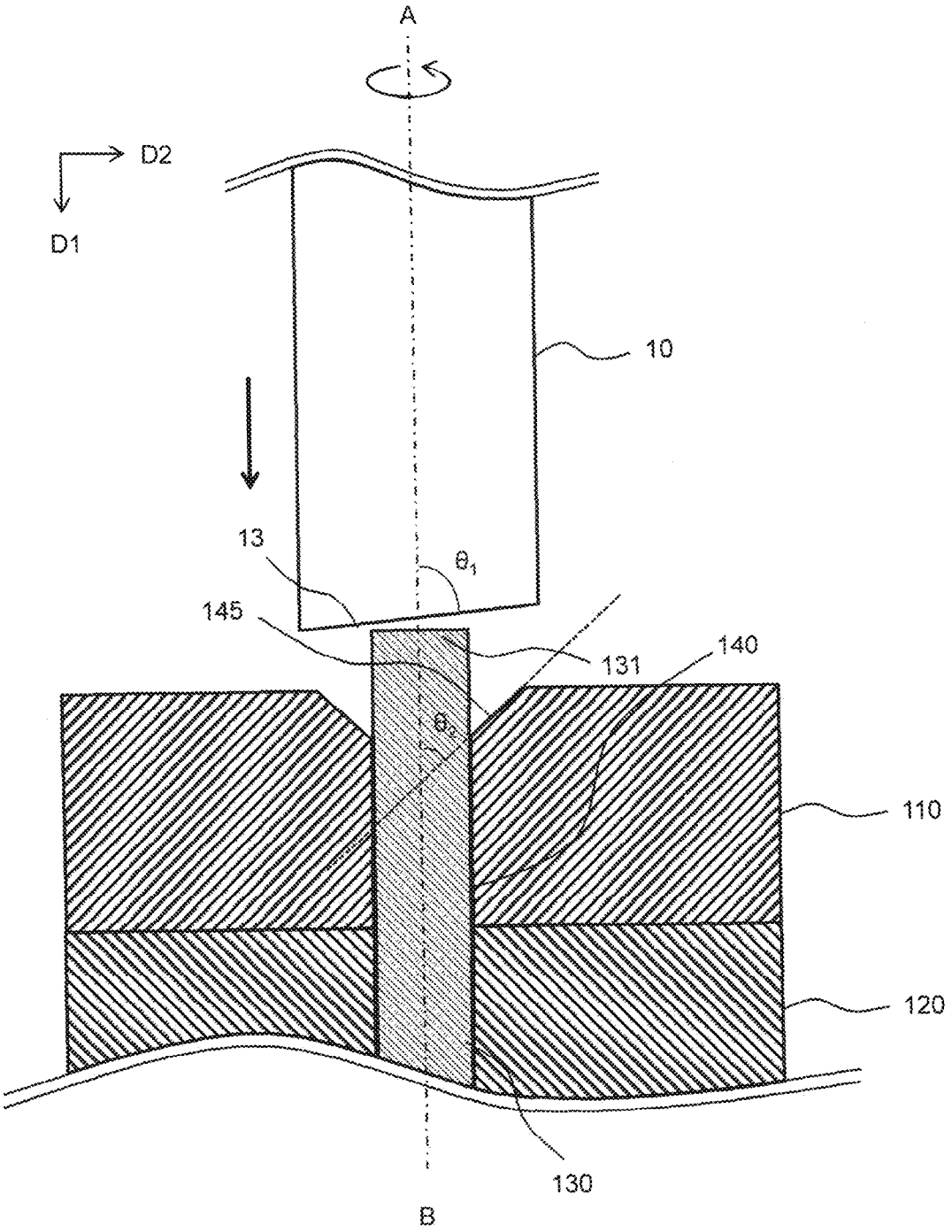
FIG. 3 is a schematic view showing a method for joining members using the punch 10 for riveting according to an embodiment of the present invention.

FIG. 3 is a schematic view showing a method for joining members using the punch 10 for riveting according to an embodiment of the present invention. The through hole 140 for arranging the rivet 130 is arranged in the first member 110 and the second member 120. The convex part (end portion) 131 of the rivet 130 protruding from the through hole 140 on the first member 110 side is riveted by the punch 10 for riveting according to the present embodiment. As described above, in the punch 10 for riveting, the contact surface 13 is inclined by $\theta_1$ with respect to the center axis A. The punch 10 for riveting is connected to the device 1000 described above.

The center axis A of the punch 10 for riveting is connected to the device 1000 so as to substantially coincide with the vertical direction D1, preferably to coincide with the vertical direction D1. As a result, the contact surface 13 is arranged inclined by $\theta_1$ with respect to the vertical direction D1. In an embodiment, $\theta_1$ is in a range of 80° to 89°.

In addition, in the present embodiment, a punch for riveting having a diameter 1 to 2 mm larger than the maximum diameter of the enlarged diameter portion 145 of the through hole 140 for arranging the rivet 130 is selected as the punch 10 for riveting. If a punch for riveting having a diameter smaller than the maximum diameter of the enlarged diameter portion 145 of the through hole 140 is used, a ring-shaped gap in which the material of the rivet 130 is not filled occurs in an edge portion defined by a surface of the first member 110 and the enlarged diameter portion 145, which is not preferable.

The convex part 131 of the rivet 130 is fitted into the through hole 140 disposed in the first member 110 and the second member 120, and the center axis B of the rivet 130 is disposed so as to coincide with the center axis A of the punch 10 for riveting. In addition, the rivet 130 is not particularly limited, and a known rivet can be used, and may be a commercially available product or a dedicated product. The rivet 130 is made of a known material capable of being plastically deformed by riveting such as aluminum or nickel, and capable of joining the first member 110 and the second member 120.

By arranging the punch 10 for riveting and the rivet 130 in this manner, the convex part 131 of the rivet 130 is pressed while rotating the punch 10 for riveting around the center axis A as a rotation axis, thereby plastically deforming the material constituting the convex part 131 of the rivet 130. The material constituting the convex part 131 of the rivet 130 moves in the center axis B direction (vertical direction D1) of the rivet 130 and in the plane direction (horizontal direction D2) of the first member 110, and the convex part 131 of the rivet 130 becomes larger than the diameter of the through hole 140, so that the first member 110 and the second member 120 are joined by the rivet 130. At this time, it is preferable that the enlarged diameter portion 145 is completely filled with the material constituting the convex part 131 of the rivet 130 without any gap.

In the present embodiment, as shown in FIG. 3, since the direction in which the punch 10 for riveting presses is coincident with the center axis B of the rivet 130, the plastically deformed material constituting the convex part 131 of the rivet 130 flows in a direction of an edge of the enlarged diameter portion 145 of the through hole 140 disposed in the first member 110 and the vertical direction D1 along the contact surface 13 of the punch 10 for riveting, and fills the enlarged diameter portion 145. Therefore, it is possible to suppress the occurrence of gaps as in the case of using the conventional punch 90 for spin riveting.

In an embodiment, an inner surface of the through hole 140 may include an area that is parallel to or inclined with respect to the center axis B of the rivet 130. In an embodiment, the enlarged diameter portion 145 of the through hole 140 may be inclined by $\theta_2$ to the center axis B. In an embodiment, $\theta_2$ may be in a range of 0° to 60°, preferably in a range of 30° to 45°. The plastically deformed material constituting the convex part 131 of the rivet 130 is filled in the enlarged diameter portion 145 without generating a gap by the enlarged diameter portion 145 of the through hole 140 having an inclination within this range, and it is possible to suppress the occurrence of fine cracks of the rivet 130 due to effects of temperature when using the product.

EXAMPLES

Comparative Example 1

Figure 7A:
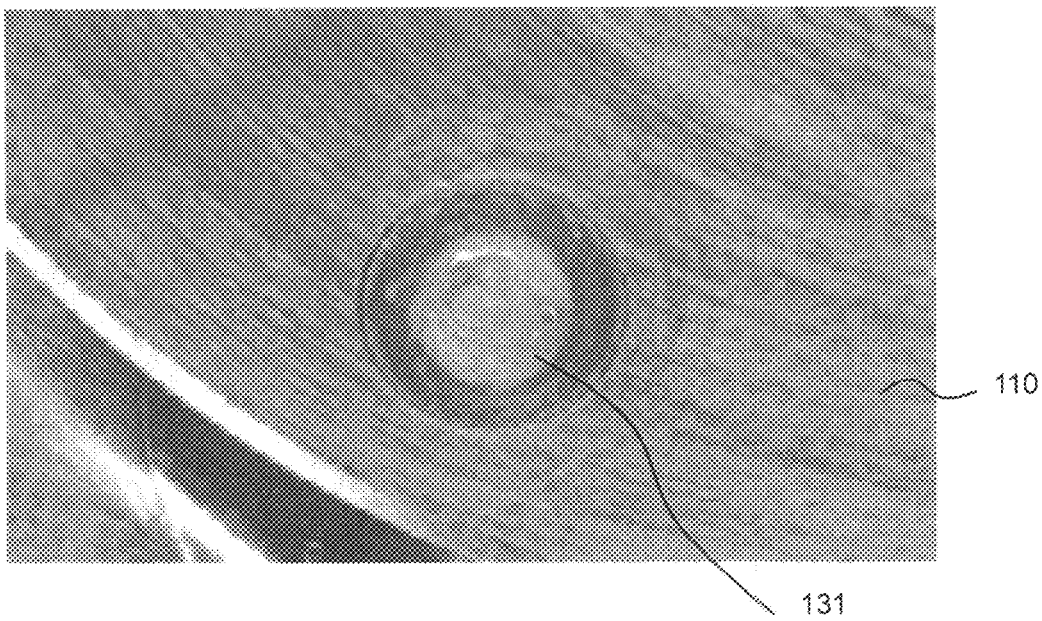
FIG. 7A is a top view of a member of Comparative example 1 in which a rivet is riveted.
Figure 7B:
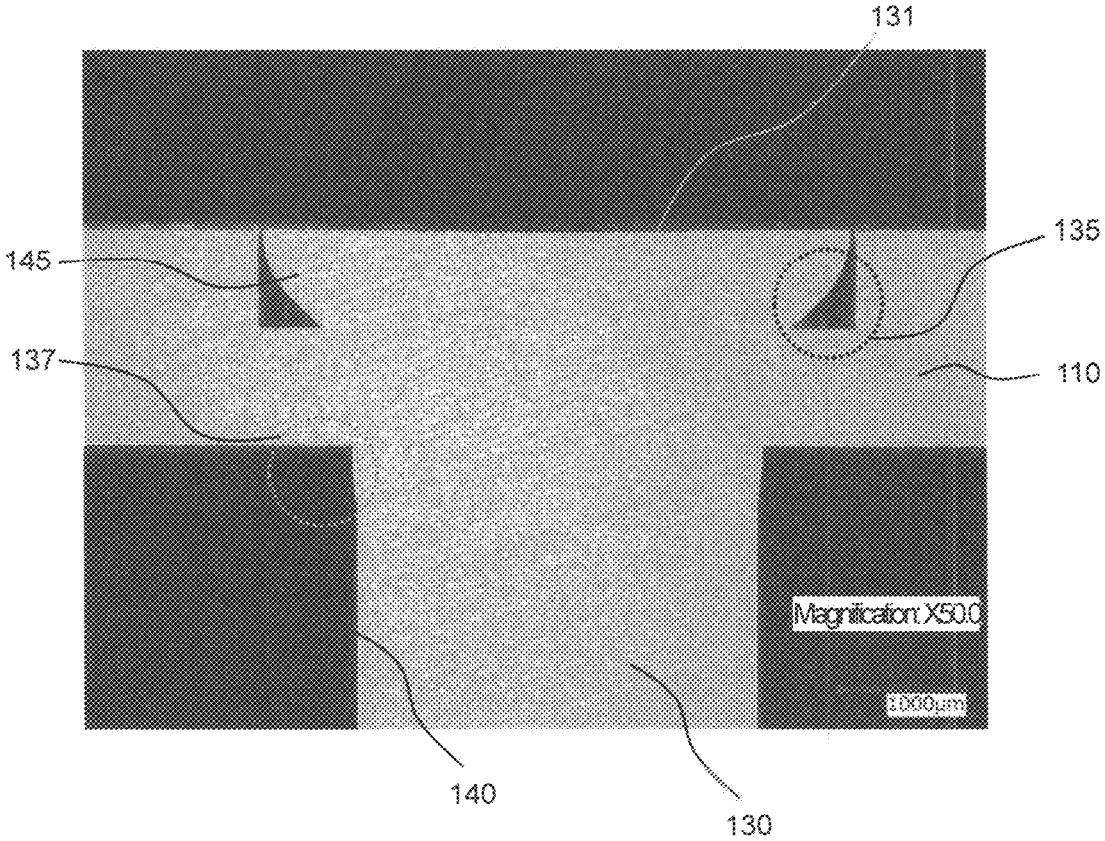
FIG. 7B is an optical microscopic image of a cross section of the member of the Comparative example 1 in which the rivet is riveted.

As Comparative example 1, a rivet was riveted using the conventional punch 90 for spin riveting described above. The punch 90 for spin riveting is connected to a spin riveting device in a state inclined by 5° using a member including the through hole 140 having a diameter of 2.6 mm and the enlarged diameter portion 145 having a diameter of 4.7 mm, the rivet 130 having a diameter of 2.58 mm, and the conventional punch 90 for spin riveting having the diameter of 5.0 mm, and the rivet 130 was riveted to the member with a load of 12 kN. FIGS. 7A and 7B are diagrams showing the members of the Comparative example 1 obtained by riveting the rivet. FIG. 7A is a top view of the members of the Comparative example 1 riveted with the rivet, FIG. 7B is an optical microscopic image of a cross-section of the members of the Comparative example 1 riveted with the rivet. In the case of using the conventional punch 90 for spin riveting, although it was determined that the riveted state is good in appearance (top view), it has been clarified that the gap 135 is formed between the enlarged diameter portion 145 of the through hole 140 and the materials constituting the convex part 131 of the rivet 130 from the optical microscope image of the cross section. In addition, it has been clarified that a deformation 137 occurs in a portion of the rivet 130 in contact with the through hole 140.

Example 1

Figure 8:
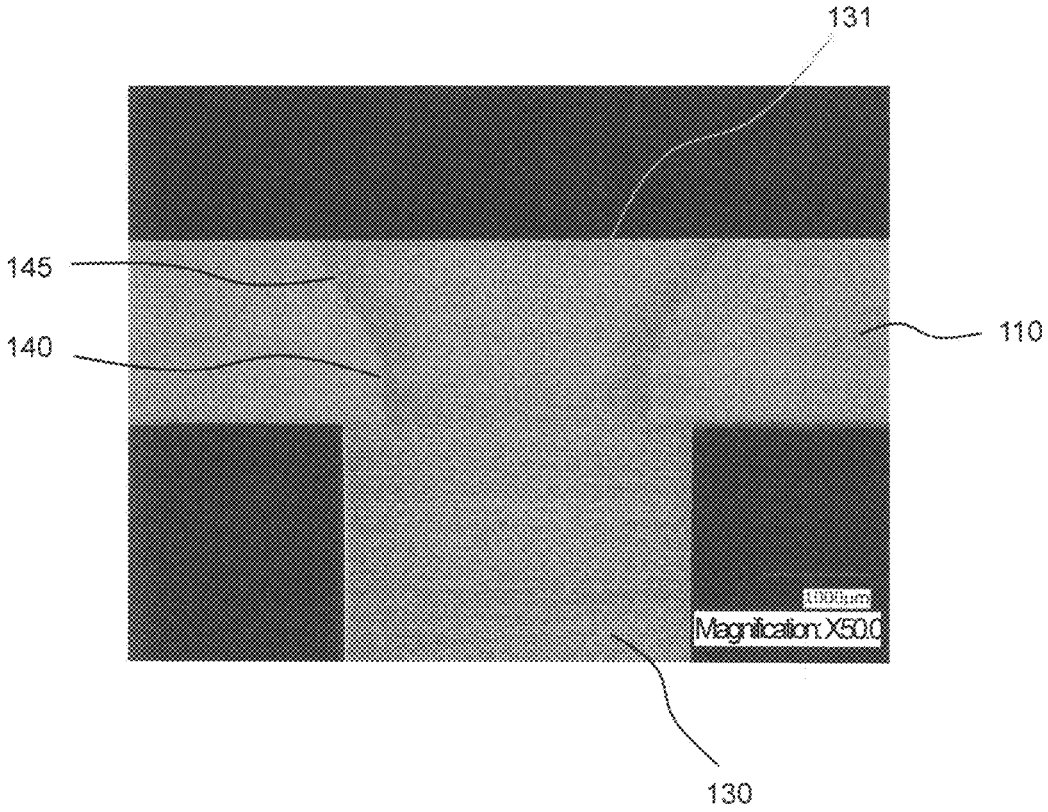
FIG. 8 is an optical microscope image of a cross section of a member of Example 1 in which a rivet is riveted.

Example 1, a rivet was riveted using the punch 10 for riveting according to the present invention described above. The punch 10 for riveting was connected to the machining center in a state in which the center axis A of the punch 10 for riveting coincides with the center axis B of the rivet 130 using the punch 10 for riveting of the Example 1 having the contact surface 13 which is inclined by 5° with respect to the center axis A and a diameter of 6 mm, a member including the through hole 140 having a diameter of 2.7 mm, and the enlarged diameter portion 145 having a diameter of 4.7 mm, and the rivet 130 having a diameter of 2.58 mm, and the rivet 130 was riveted to the member at a feed rate of 50 mm/min. The enlarged diameter portion 145 is inclined by 30° with respect to the center axis B. FIG. 8 is an optical microscope image of a cross section of the member of the Example 1 riveted with the rivet. In the case of using the punch 10 for riveting of the Example 1, the enlarged diameter portion 145 of the through hole 140 is completely filled with the material constituting the convex part 131 of the rivet 130, and no gaps were observed from the optical microscope image of the cross section. Further, no deformation occurred in a portion of the rivet 130 in contact with the through hole.

Example 2

The rivet used in the Example 1 and three types of members in which the enlarged diameter portion 145 is inclined by 30° with respect to the center axis B were used. The punch 10 for riveting of Example 1 having the contact surface 13 inclined by 5° with respect to the center axis A and having a diameter of 6 mm was connected to the machining center in a state in which the center axis A of the punch 10 for riveting coincides with the center axis B of the rivet 130, and the rivet 130 was riveted to the member at a feed rate of 50 mm/min. Thereafter, the riveted member and a surface of the rivet were cut using an end mill.

Figure 9A:
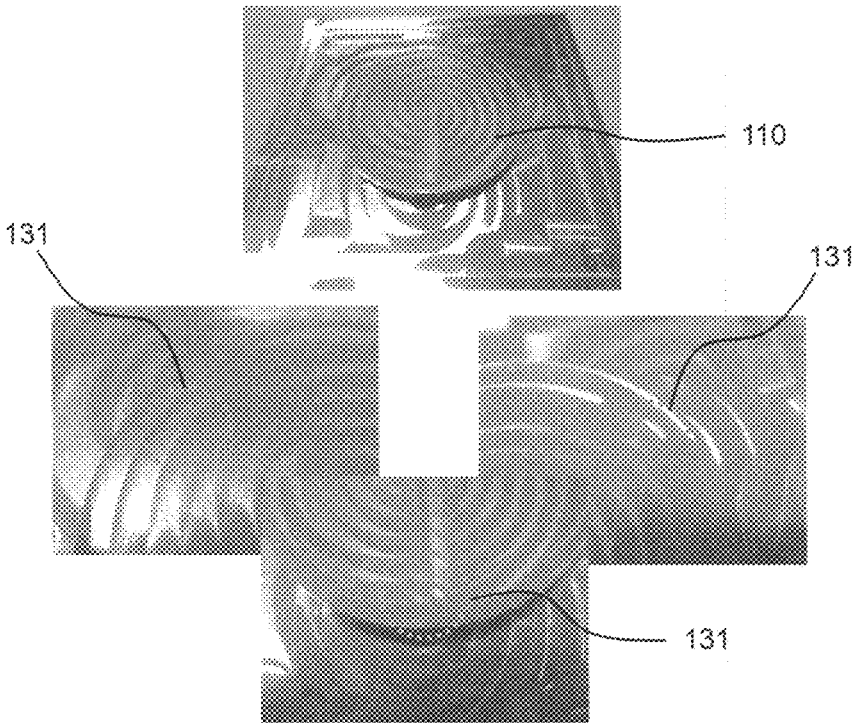
FIG. 9A is a diagram showing a top surface of a member of Example 2 in which a rivet is riveted.
Figure 9B:
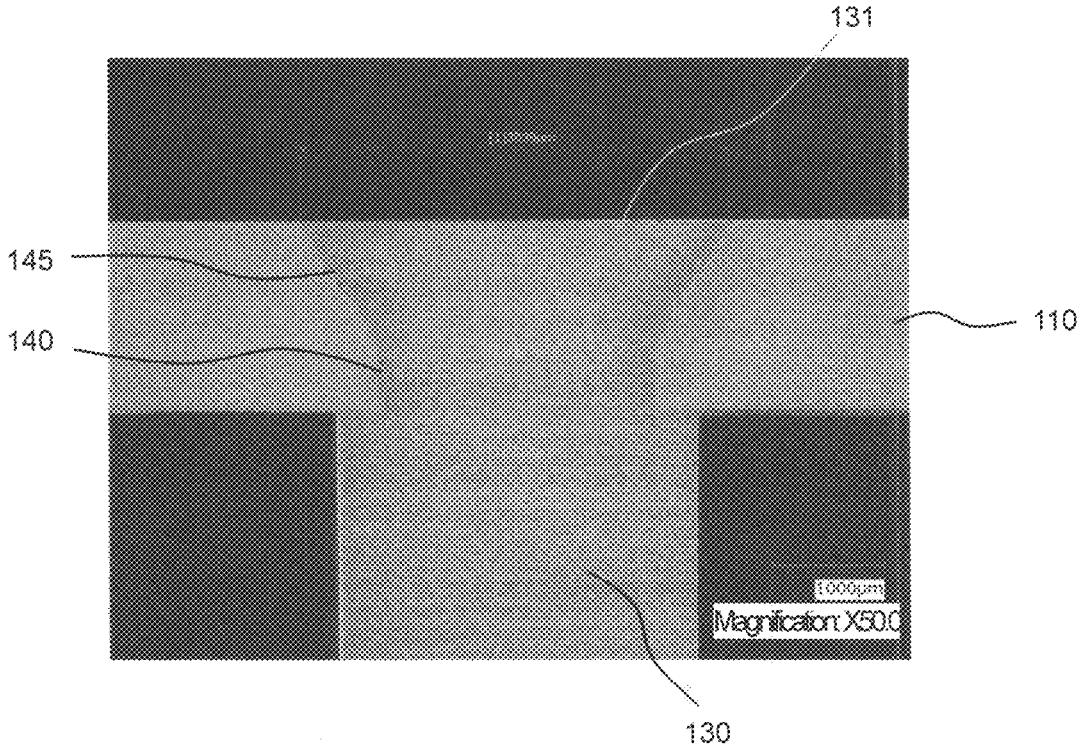
FIG. 9B is an optical micrograph of a cross section of the member of the Example 2 in which the rivet is riveted.

FIG. 9A is a diagram showing a top surface of the member of Example 2 riveted with the rivet, FIG. 9B shows an optical microscopic image of the cross section. In Example 2, the material of the rivet 130 was completely filled in the through hole 140 and the enlarged diameter portion 145, and even if a surface was cut and flattened, good bonding between the member and the rivet was confirmed.

Evaluation of Adhesion

Figure 10A:
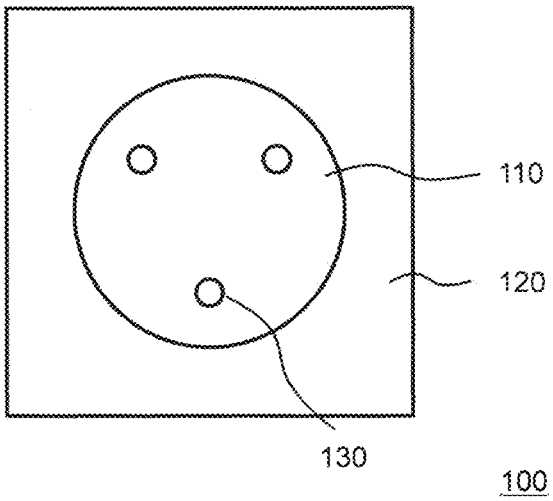
FIG. 10A is a top view of a product 100 of an example.
Figure 10B:
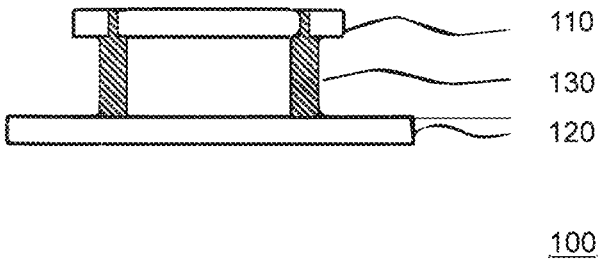
FIG. 10B is a cross-sectional end view of the product 100.

The product 100 was manufactured by joining the first member 110 composed of a disk-shaped aluminum (A6061-T6) material having a diameter of 60 mm and a thickness of 4 mm having the enlarged diameter portion 145 inclined by 30° with respect to the center axis B and the through hole 140 having a diameter of 2.7 mm with the second member 120 composed of a plate-shaped aluminum (A6061-T6) material having a diameter of 100 mm×100 mm on each side and a thickness of 10 mm by using the rivet 130 having a diameter of 2.7 mm (FIGS. 10A and 10B). The punch 10 for riveting having the contact surface 13 inclined by 5° with respect to the center axis A and a diameter of 6 mm was used. In the state that the second member 120 of the product 100 was secured, the first member 110 was pulled and its force was measured. Consequently, the product 100 was not destroyed when pulled above 67 kgf.

Although an embodiment of the present invention has been described with reference to the drawings, the present invention is not limited to the embodiment described above, and can be appropriately modified without departing from the spirit of the present invention. For example, a person skilled in the art may appropriately add, delete, or make changes in the design of the components based on the punch for riveting and the method for joining the members of the present embodiment and such changes are included in the scope of the present invention as long as the spirit of the present invention is included. Furthermore, the embodiments described above can be appropriately combined as long as there are no mutual contradictions, and technical matters common to the embodiments are included in the embodiments without explicit description.

It is to be understood that the present invention provides other effects that are different from the effects provided by the aspects of the embodiments described above in the case where those that are obvious from the description of the present specification or those that can be easily predicted by a person skilled in the art.

An embodiment of the present invention provides a novel punch for riveting with reduced load on a shaft of a rivet. Alternatively, an embodiment of the present invention provides a device in which a novel punch for riveting having a reduced load on a shaft of a rivet is disposed. Alternatively, an embodiment of the present invention provides a method for joining members using a novel punch for riveting with reduced load on a shaft of the rivet.

What is claimed is:

1. A punch for riveting and joining a first member having a convex part and a second member having a through hole fitting with the convex part by plastically deforming the convex part, wherein the punch has a contact surface in contact with the convex part, and the contact surface is inclined at a range of 80° to 89° with respect to a center axis of the punch, the contact surface has an elliptical shape in which an inclined direction is set to a major axis, and a rotation axis of the punch coincides with the center axis of the punch.

2. The punch according to claim 1, wherein the punch for riveting contains a cemented carbide alloy.

3. The punch according to claim 1, wherein the contact surface has an arithmetic average roughness (Ra) of 3.2 or less.

4. The punch according to claim 1, wherein the punch for riveting further comprises a coating composed of diamond-like carbon arranged on the contact surface.

5. A device comprising:

a main shaft holding the punch according to claim 1; and a table arranged opposite to the main shaft, the table capable of holding the first member and the second member, wherein the punch and the first member are arranged so that the center axis of the punch corresponds to a center axis of the first member, and the main shaft rotates the punch around the center axis of the punch.

6. A method for joining a first member and a second member comprising:

fitting a convex part of a first member and a through hole of a second member; and rotating and pressing a punch having a contact surface with the convex part, the contact surface inclined at a range of 80° to 89° with respect to a center axis of the punch, wherein the contact surface has an elliptical shape in which an inclined direction is set to a major axis, and a rotation axis of the punch coincides with the center axis of the punch.

7. The method according to claim 6, wherein the punch rotates around the center axis.

8. The method according to claim 6, wherein the first member and the second member are joined by plastically deforming the convex part.

9. The method according to claim 6, wherein the punch contains a cemented carbide alloy.

10. The method according to claim 6, wherein the contact surface is polished.

11. The method according to claim 6, wherein a center of the convex part is arranged in the center axis.

12. The method according to claim 6, wherein an inner surface of the through hole includes an area parallel to or inclined with respect to the center axis.

13. The method according to claim 6, wherein the contact surface is coated with diamond-like carbon.

* * * * *